United States Patent [19]

Hart

[11] Patent Number: 4,579,239

[45] Date of Patent: Apr. 1, 1986

[54] CONTAINER AND CHILD RESISTANT CLOSURE ASSEMBLY

[75] Inventor: Reginald J. Hart, Chapel-en-le-Frith, England

[73] Assignees: Roymere Limited, Cheshire; Hart Sys. Ltd., Derbyshire, both of England

[21] Appl. No.: 725,666

[22] Filed: Apr. 22, 1985

[30] Foreign Application Priority Data

Apr. 24, 1984 [GB] United Kingdom ..... 8410452
Oct. 22, 1984 [GB] United Kingdom ..... 8426647

[51] Int. Cl.[4] ..... B65D 55/02

[52] U.S. Cl. ..... 215/224; 215/216; 215/218

[58] Field of Search ..... 215/216, 217, 218, 219, 215/224, 211

[56] References Cited

U.S. PATENT DOCUMENTS

| | | | |
|---|---|---|---|
| 3,695,475 | 10/1972 | Ruekberg | 215/216 |
| 3,923,181 | 12/1975 | Libit | 215/224 |
| 3,986,626 | 10/1976 | Montgomery | 215/217 |
| 4,058,232 | 11/1977 | Ohno et al. | 215/224 |
| 4,171,057 | 10/1979 | Gach | 215/211 |

FOREIGN PATENT DOCUMENTS

| | | |
|---|---|---|
| 1464739 | 2/1977 | United Kingdom . |
| 1560583 | 2/1980 | United Kingdom . |
| 2075477 | 4/1981 | United Kingdom . |
| 2111030 | 10/1982 | United Kingdom . |

*Primary Examiner*—George T. Hall
*Attorney, Agent, or Firm*—Bruns and Wall

[57] ABSTRACT

An assembly of a container (1) and a child resistant closure (5) therefor. The container (1) has an external bead (3) on the neck (2) thereof and the closure (5) an inturned flange (8) on the skirt (7) thereof which makes snap engagement with the bead (3). The neck (2) of the container (1) comprises an external screw thread (4) while the skirt (7) of the closure (5) is locally severed or weakened to provide local deformable skirt portions (11) which can be deformed inwards by finger pressure thereon to enage thread portions (13) on the skirt portions (11) with the screw thread (4). The closure (5) is removable from the container (1) by deforming the skirt portions (11) to engage the thread portions (13) with the screw thread (4) by finger pressure thereon and rotating the closure (5) relative to the container (1) while maintaining said finger pressure.

12 Claims, 8 Drawing Figures

CONTAINER AND CHILD RESISTANT CLOSURE ASSEMBLY

Figure 1:
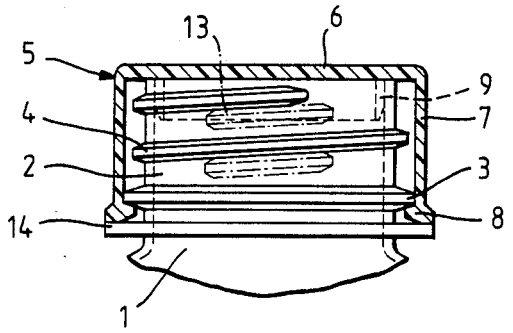

This invention relates to container and child resistant closure assemblies.

The present invention has as its object to provide an assembly of a container and a child resistant closure therefor such that the container can be a conventional screw top container adapted to receive a conventional screw cap and the closure can be simple and effective in use, economical to manufacture and capable of complying with British Standard specifications.

The present invention provides an assembly of a container and a child resistant closure therefor, the container having an externally screw threaded neck portion defining a mouth and an external bead on the neck portion; the closure comprising a top wall, a skirt depending from the top wall, and an internal flange on the skirt which is a snap fit with said bead, the skirt being locally weakened and/or severed to provide at least one local deformable skirt portion, said at least one skirt portion having at least one projection thereon which is normally out of engagement with said screw thread, the closure being removable from the container by deforming the at least one skirt portion by finger pressure thereon to engage the at least one projection with the screw thread and effecting relative rotation between the closure and the container whilst maintaining said finger pressure.

The container may be a bottle, phial or the like. Preferably, local deformable skirt portions are provided at diametrically opposite sides of the skirt.

Said external bead may be spaced from the mouth of the container whilst said inturned flange may be provided around the free rim of the skirt remote from the top wall. The said bead and/or the said inturned flange may be continuous or discontinuous. Where the internal flange is discontinuous it is preferred that the flange be interrupted in the region of the or each said skirt portion. If desired, an outwardly directed annular flange may be provided on the neck of the container below said external bead so that the inturned flange of the closure is received between the external bead and the annular flange on the neck of the container to prevent or discourage prising off of the closure.

The or each said skirt portion is preferably of thinner wall section than the remainder of the skirt. Thus the or each skirt portion may be sufficiently thin in wall section and sufficiently flexible to enable it to be deformed inwards towards the neck of the container by finger pressure thereon whilst the remainder of the skirt may be thicker and relatively stiff or inflexible to prevent the closure being too easily prised off the container.

Alternatively, or in addition, the at least one said skirt portion may be defined by slits which partially separate the at least one skirt portion from the remainder of the skirt. The closure may comprise a plug portion, depending from the top wall thereof, adapted to fit tightly within the mouth of the container to provide additional sealing if required. The axial extent of the plug portion may be such that when the closure is being assembled with the container the plug portion will engage the mouth of the container prior to said inturned flange making snap fit engagement with said bead. In this way the plug portion guides the closure and maintains it accurately located relative to the container during assembly and disassembly.

The container may be formed from glass, plastics or other suitable material whilst the closure is preferably formed, e.g., moulded from a suitable plastics material, preferably polypropylene.

Figure 2:
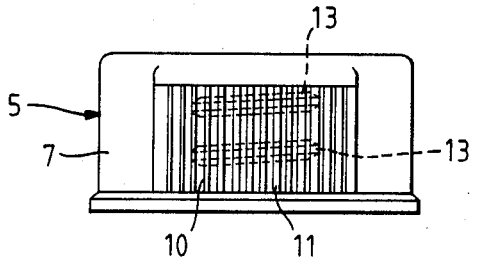
Figure 3:
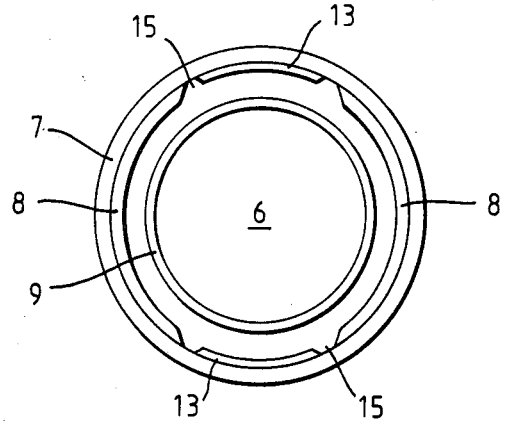
Figure 4:
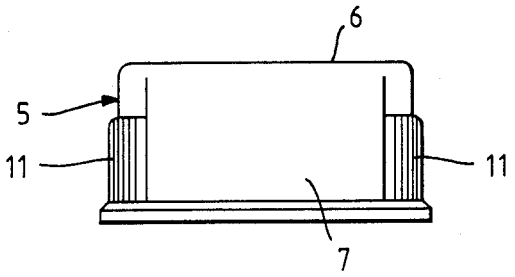
Figure 5:
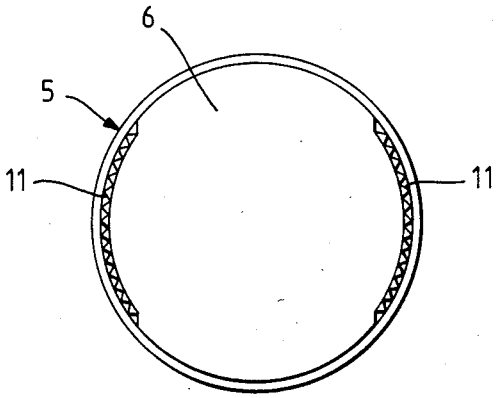
Figure 6:
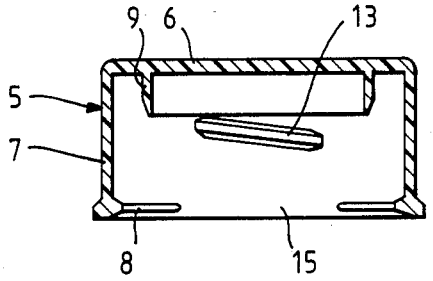
Figure 7:
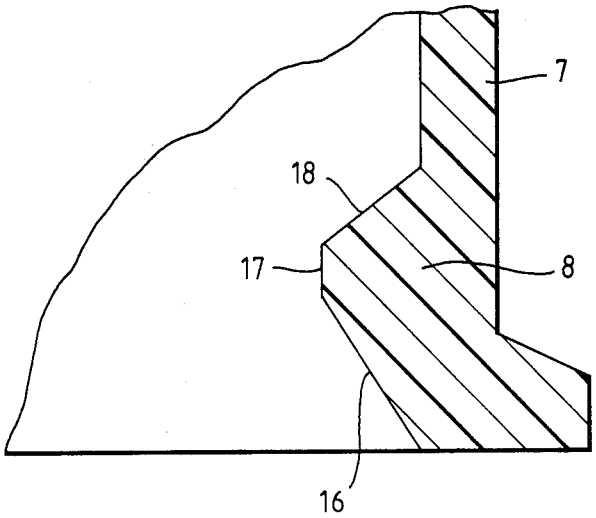
Figure 8:
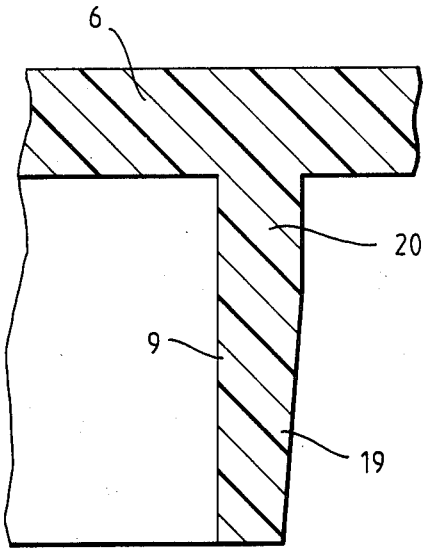

The present invention will be more particularly described with reference to the accompanying diagrammatic drawings, in which:

FIG. 1 is a fragmentary sectional elevation of a container and child resistant closure according to one embodiment of the present invention, FIG. 2 is a side elevation of the closure of the embodiment of FIG. 1, FIG. 3 is a bottom plan view of the closure of FIG. 2, FIG. 4 is a side elevation of the closure taken at right angles to FIG. 2, FIG. 5 is a top plan view of the closure, FIG. 6 is a sectional elevation of the closure, FIG. 7 is an enlarged fragmentary sectional elevation through the inturned flange of the closure, and FIG. 8 is an enlarged fragmentary section through the plug portion of the closure.

Referring to the drawings it will be seen that the assembly illustrated therein comprises a container 1 having a neck portion 2 provided with an external bead 3 and an external screw thread 4 and a closure 5 having a top wall 6 and a depending skirt 7 which terminates in an inturned flange 8 adapted to make snap engagement with the external bead 3 as shown in FIG. 1. The closure 5 has a plug portion 9 depending from the top wall 6 which is a close fit in the mouth of the container 1 to provide a seal.

The skirt 7 of the closure 5 is locally weakened to provide two diametrically opposed local deformable skirt portions 11. The local deformable skirt portions 11 have on the internal surface thereof thread portions 13 adapted to cooperate with the external screw thread 4 of the neck 2 of the container 1 when the portions 11 are deformed inwardly by finger pressure thereon. Thus, to release the snap engagement of the inturned flange 8 with the external bead 3, finger pressure is applied to the skirt portions 11 to engage the thread portions 13 with the external screw thread 4 and such finger pressure is maintained whilst the closure 5 is rotated anticlockwise as shown in the drawings relative to the container 1 to screw the closure 5 off the neck of the container 1. One skirt portion 11 has a single thread portion 13 thereon whilst the other skirt portion 11 has two thread portions 13 which are spaced in the axial direction of the closure, although other arrangements could be adopted if desired.

The local deformable skirt portions 11 are of thinner wall section than the remainder of the skirt 7 and are sufficiently flexible to be readily deformable by finger pressure thereon. The remainder of the skirt 7 is relatively stiff or inflexible as compared to the skirt portions 11 to resist the closure being too easily prised off the container whilst retaining enough flexibility to permit the snap engagement.

In addition to the external bead 3, the neck 2 of the container 1 has an optional outwardly directed annular flange 14 below the external bead 3 so that the inturned flange 8 of the skirt 7 is received between the external bead 3 and the annular flange 14. The annular flange 14 discourages prising off of the closure 5.

The external surface of the skirt portions 11 is preferably ribbed, roughened or otherwise formed as shown at 10 so that the portions 11 can be identified by feel even in the dark or by a person with poor eyesight.

The inturned flange 8 of the skirt 7 is interrupted in two places as shown at 15 in the region of the skirt portions 11. This allows a deeper engagement of the flange 8 beneath the bead 3, a greater variation in bead tolerance and greater distortion of the skirt 7 where the flange is interrupted which assists the snap engagement.

Referring to FIG. 7 it will be seen that the inturned flange 8 has a first inclined cam surface 16 which assists the snap engagement of the flange 8 with the bead 3, an intermediate axially extending surface 17 the length of which controls the angular distance over which finger pressure must be maintained on the skirt portions 11 as the closure is rotated relative to the container to release the snap engagement of the flange 8 with the bead 3 when removing the closure, and a second cam surface 18 which engages the bead 3 and serves to urge the closure down on to the neck of the container.

Referring now to FIG. 8 it will be seen that the cross-section of the plug portion 9 is such as to provide an inwardly tapered outer portion 19 which provides a lead-in when the plug portion enters the mouth of the container and a straight cylindrical portion 20 which makes tight sealing engagement with the inner surface of the neck of the container.

Preferably the axial extent of the plug portion 9 is at least one third the depth of the skirt 7.

The top wall 6 of the closure 5 may have suitable instructions thereon such as "To remove squeeze ribbed sides and unscrew".

The container 1 may be a conventional bottle or phial of glass, plastics or other suitable material. The closure 5 is preferably formed, e.g., moulded, from a suitable plastics material, preferably polypropylene.

It will readily be understood that the present invention provides a container and a child proof closure therefor wherein the container can be a conventional bottle having an externally screw threaded neck for the reception of a conventional screw cap. It will also be appreciated that the closure is simple and effective in use, relatively cheap to manufacture and can accord with British Standard specifications.

I claim:

1. An assembly of a container and a child resistant closure therefor, the container having a neck portion defining a mouth, an external bead on the neck portion and an external screw thread on the neck portion between said mouth and said external bead; the closure comprising a top wall, a skirt depending from the top wall, an internal flange on the skirt around the free rim thereof which is a snap fit with said bead, the skirt being locally weakened to provide at least one local deformable skirt portion, said at least one skirt portion having at least one projection thereon which is normally out of engagement with said screw thread, the closure being removable from the container by deforming the at least one skirt portion by finger pressure thereon to engage the at least one projection with the screw thread and effecting relative rotation between the closure and the container whilst maintaining said finger pressure and a plug portion depending from said top wall and adapted to fit tightly in the mouth of the container, the axial extent of the plug portion being such that when the closure is being assembled with the container the plug portion will engage the mouth of the container prior to said inturned flange making snap fit engagement with said bead.

2. An assembly according to claim 1, wherein local deformable skirt portions are provided at diametrically opposed sides of the skirt.

3. An assembly according to claim 1, wherein said inturned flange is discontinuous.

4. An assembly according to claim 3, wherein said inturned flange is interrupted in the region of the or each said skirt portion.

5. An assembly according to claim 1, wherein an outwardly directed annular flange is provided on the neck of the container below said external bead so that the inturned flange of the closure is received between the external bead and the annular flange on the neck of the container.

6. An assembly according to claim 1, wherein the external surface of the said at least one skirt portion is formed so that it can be distinguished by feel.

7. An assembly according to claim 1, wherein said at least one projection comprises at least one thread portion adapted to cooperate with the external screw thread on the neck of the container when the at least one skirt portion is deformed inwardly towards said neck by finger pressure on the at least one skirt portion.

8. An assembly according to claim 2, wherein said at least one projection comprises at least one thread portion adapted to cooperate with the external screw thread on the neck of the container when the said opposed skirt portions are deformed inwardly towards the neck portion by finger pressure on the skirt portions, and wherein one of said diametrically opposed skirt portions comprises a single thread portion and the other of said skirt portions comprises two thread portions spaced axially of the closure.

9. An assembly according to claim 1, wherein said at least one skirt portion is of thinner wall section than the remainder of the skirt.

10. An assembly according to claim 9, wherein the remainder of the skirt is relatively stiff and inflexible compared to the at least one skirt portion.

11. An assembly according to claim 1, wherein the at least one skirt portion is defined by slits which partially separate the at least one skirt portion from the remainder of the skirt.

12. An assembly according to claim 1, wherein said inturned flange comprises, in the direction of assembly of the closure with the container, a leading cam surface for first engaging said bead and camming the inturned flange over the bead and a trailing cam surface which engages behind the bead to retain the closure on the container.

* * * * *